US011257647B1

(12) United States Patent
Liao

(10) Patent No.: US 11,257,647 B1
(45) Date of Patent: Feb. 22, 2022

(54) ELECTROMAGNETIC RELAY

(71) Applicant: SONG CHUAN PRECISION CO., LTD., New Taipei (TW)

(72) Inventor: Po-Jen Liao, New Taipei (TW)

(73) Assignee: SONG CHUAN PRECISION CO., LTD., New Taipei (TW)

( * ) Notice: Subject to any disclaimer, the term of this patent is extended or adjusted under 35 U.S.C. 154(b) by 0 days.

(21) Appl. No.: 17/153,891

(22) Filed: Jan. 21, 2021

(51) Int. Cl.
*H01H 50/64* (2006.01)
*H01H 50/54* (2006.01)

(52) U.S. Cl.
CPC ..... *H01H 50/641* (2013.01); *H01H 50/54* (2013.01); *H01H 50/643* (2013.01)

(58) Field of Classification Search
CPC ..... H01H 50/643; H01H 50/641
USPC ..... 335/129
See application file for complete search history.

(56) References Cited

U.S. PATENT DOCUMENTS

| | | | | |
|---|---|---|---|---|
| 7,659,800 | B2 * | 2/2010 | Gruner | H01H 51/2281 335/78 |
| 7,982,562 | B2 * | 7/2011 | Yang | H01H 1/28 335/78 |
| 9,305,718 | B2 * | 4/2016 | Iwamoto | H01H 1/50 |
| 2009/0033446 | A1 * | 2/2009 | Gruner | H01H 1/26 335/129 |
| 2013/0229246 | A1 * | 9/2013 | Fujita | H01H 51/2263 335/189 |
| 2019/0013172 | A1 * | 1/2019 | Hayashida | H01H 50/56 |

* cited by examiner

*Primary Examiner* — Alexander Talpalatski
(74) *Attorney, Agent, or Firm* — Fei-hung Yang

(57) ABSTRACT

An electromagnetic relay includes a casing, a coil set, a rotating bridge, first and second extension arm, first and second switch conductive plate assemblies, and first and second gripper modules. The novel design of the rotating bridge allows the first and second switch conductive plate assemblies to have synchronous contact or disconnection and provide sufficient and appropriate force to a first movable contact and a first fixed contact of the first switch conductive plate assembly and a second movable contact and a second fixed contact of the second switch conductive plate assembly to achieve a stable conduction and ensure a reliable separation for a disconnection, so as to achieve the effects of reducing the excessive change of resistance during operation, preventing high temperature caused by incomplete contacts, and improve application performance.

16 Claims, 11 Drawing Sheets

ELECTROMAGNETIC RELAY

BACKGROUND

Technical Field

The present disclosure relates to the technical field of relays. More particularly, the present disclosure relates to an electromagnetic relay with novel structural characteristics that improve the stability of application.

Description of Related Art

Relay, also known as electrical relay, is an electronic control component, and it can be divided according to its working principle into photorelay, electromagnetic relay, thermal relay, etc.

The electromagnetic relay is generally equipped with an electromagnetic coil, a movable contact and a fixed contact, and the fixed contact is externally connected to a control circuit. After the electromagnetic coil is electrically conducted, the movable contact will be shifted by the electromagnetic effect of the electromagnetic coil to control electrical connection or disconnection. As the application requirement of the electromagnetic relay varies, the design of the relay tends to be more complicated, and it is a challenge for related manufacturers to maintain the stability of electrical conduction of the complicated electronic components during the operation of the relay.

SUMMARY

Therefore, it is a primary objective of the present disclosure to provide an electromagnetic relay that allows a plurality of switch conductive plate assemblies to have synchronous contact or disconnection, as well as providing sufficient and appropriate forces to the contacts of the switch conductive plate assemblies to achieve the effects of stabilizing the conducted status, ensuring a reliable separation of the disconnection to reduce excessive resistance during operation, and preventing the high temperature caused by incomplete contact of the contacts.

To achieve the foregoing and other objectives, the present disclosure discloses an electromagnetic relay, comprising: a casing, having a base and an upper cover; a coil set, installed in the base, and a first magnetic yoke arm and a second magnetic yoke arm extending from both ends of the axis of the coil set respectively; a rotating bridge, pivoted into the base and disposed on a side of the coil set, and the rotating bridge, comprising: a main body, having a containment and a plurality of magnetic elements installed in the containment; an abutting plate, penetrating through an upper end of the containment, and having a first abutting section and a second abutting section formed on both sides of the upper end of the containment respectively; wherein when there is a magnetic change of the coil set, the rotating bridge is rotated accordingly, so that the first abutting section abuts against an end of the first magnetic yoke arm, or the second abutting section abuts against an end of the second magnetic yoke arm; and a link plate, penetrating through a lower end of the containment, and having a penetrating portion, a first snap section, and a second snap section, and the penetrating portion being a rectangular plate disposed in the containment, and the first snap section and the second snap section being coupled to both sides of the penetrating portion respectively and extending outwardly from both sides of the lower end of the containment respectively; wherein the first snap section and the second snap section are respectively formed a downward bending configuration relative to the penetration portion, and the end of the first snap section and the end of the second snap section are respectively formed a upward bending configuration; a first extension arm, installed into a first slide groove in the base and disposed on a side of the rotating bridge, and an end of the first extension arm being snapped and coupled to the first snap section, and the first extension arm being movable up and down in the first slide groove; a first switch conductive plate assembly, installed in the base and disposed adjacent to the first extension arm, and comprising: a first pin sheet, partially fixed into the base; a first middle elastic plate, having an end fixedly coupled to the first pin sheet in the base and the other end having a first movable contact facing downward, and snapped and coupled to the first extension arm; and a first conductive plate, partially disposed in the base, and partially extending to the outside of the casing, and having a first fixed contact with a contact surface facing upward and formed at an end inside the base, and the first movable contact and the first fixed contact being configured to be corresponsive to each other; a first gripper module, fixedly coupled to the first conductive plate and disposed outside the casing; a second extension arm, installed in a second slide groove inside the base and disposed on a side of the rotating bridge, and an end of the second extension arm being snapped and coupled to the second snap section, and the second extension arm being movable up and down in the second slide groove; a second switch conductive plate assembly, installed in the base and disposed adjacent to the second extension arm, and comprising: a second pin sheet, partially fixed into the base, and a second fixed contact with a contact surface disposed at an end inside the base and facing downward; a second conductive plate, partially disposed in the base and partially extending to the outside of the casing; and a second middle elastic plate, having an end fixedly coupled to the second conductive plate installed in the base and the other end having a second movable contact with a contact surface facing upward, and this end being snapped and coupled to the second extension arm, and the second movable contact and the second fixed contact being configured to be corresponsive to each other; and a second gripper module, fixedly coupled to the second conductive plate and disposed outside the casing.

and

Figure 8:
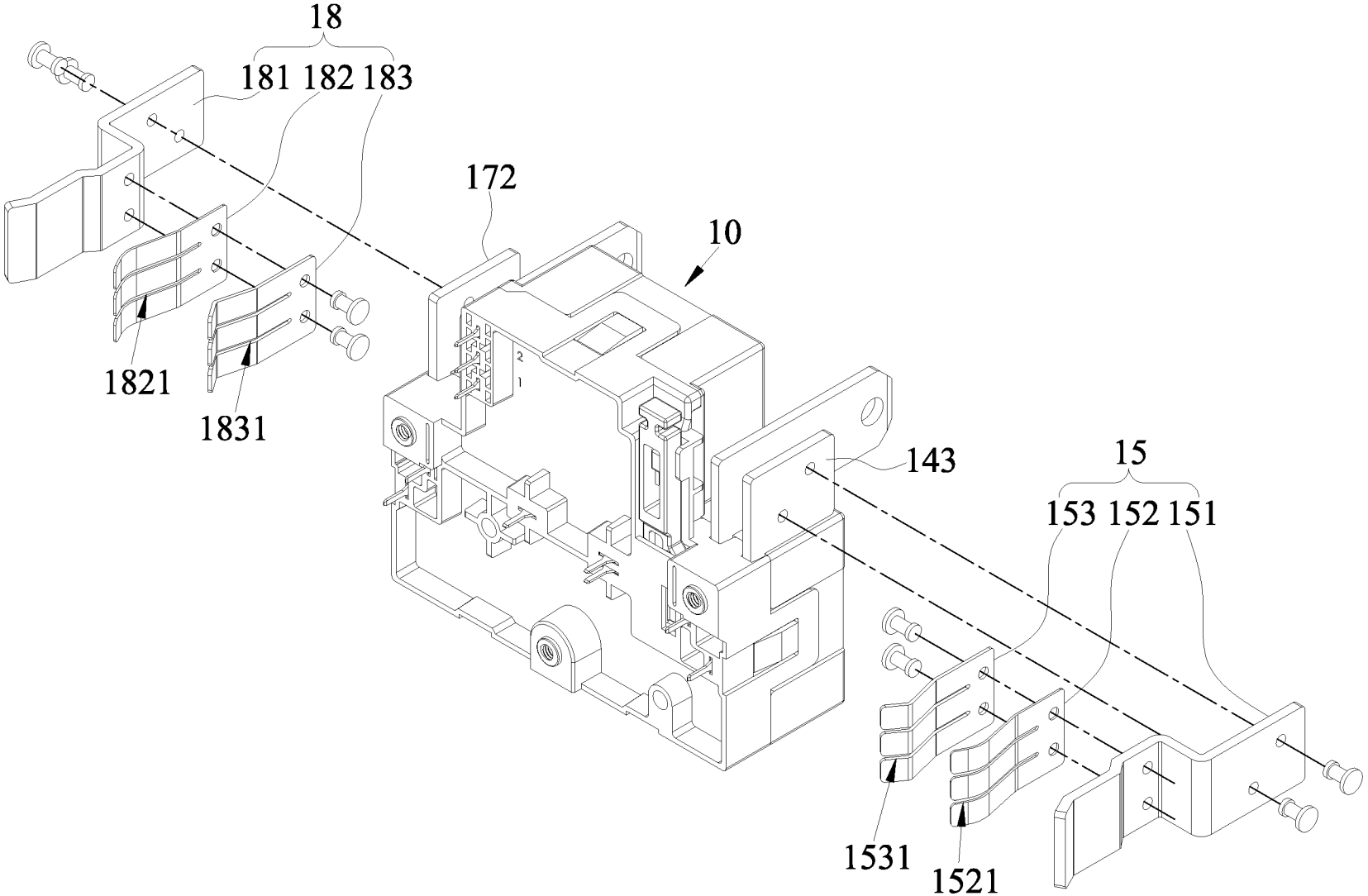

FIG. 8 is an exploded view of first and second gripper modules in accordance with another implementation mode of an embodiment of the present invention.

DESCRIPTION OF THE EMBODIMENTS

The accompanying drawings are included to provide a further understanding of the disclosure, and are incorporated in and constitute a part of this specification. The drawings illustrate embodiments of the disclosure and, together with the description, serve to explain the principles of the disclosure.

With reference to FIGS. 1, 2, 5 and 6 for the exploded view of an electromagnetic relay, the schematic view of a rotating bridge, and the first and second schematic views showing the application of an electromagnetic relay in accordance with an embodiment of the present invention respectively, the electromagnetic relay 1 comprises a casing 10, a coil set 11, a rotating bridge 12, a first extension arm 13, a first switch conductive plate assembly 14, a first gripper module 15, a second extension arm 16, a second switch conductive plate assembly 17 and a second gripper module 18. The casing 10 has a base 101 and an upper cover 102, and the upper cover 102 is covered onto the base 101. The coil set 11 is installed in the base 101, and a first magnetic yoke arm 111 and a second magnetic yoke arm 112 extend from both ends of the axis of the coil set 11 respectively.

The rotating bridge 12 is pivoted into the base 101 and disposed on a side of the coil set 11, and the rotating bridge 12 comprises a main body 121, an abutting plate 122 and a link plate 123. The main body 121 has a containment 1211 and plurality of magnetic elements 1212 installed in the containment 1211, and the abutting plate 122 penetrates through an upper end of the containment 1211, and a first abutting section 1221 and a second abutting section 1222 are formed on both sides of the upper end of the containment 1211. Wherein, when the magnetic force of the coil set 11 is changed, the rotating bridge 12 is rotated correspondingly to define a status of the first abutting section 1221 abutting against an end of the first magnetic yoke arm 111 or the second abutting section 1222 abutting against an end of the second magnetic yoke arm 112. The link plate 123 penetrates through a lower end of the containment 1211, and the link plate 123 has a penetrating portion 1233, a first snap section 1231, and a second snap section 1232, wherein the penetrating portion 1233 is a rectangular plate disposed in the containment 1211, and the first snap section 1231 and the second snap section 1232 are coupled to both sides of the penetrating portion 1233 respectively and extend outwardly from the lower end of the containment 1211. An end of each of the first snap section 1231 and the second snap section 1232 are respectively formed a downward bending configuration with respect to the penetrating portion 1233, and the end of the first snap section 1231 and the end of the second snap section 1232 are respectively formed a upward bending configuration.

The first extension arm 13 is installed in a first slide groove 1011 of the base 101 and disposed on a side of the rotating bridge 12, and an end of the first extension arm 13 is fixedly coupled to the first snap section 1231, and the first extension arm 13 is movable up and down in the first slide groove 1011. The first switch conductive plate assembly 14 is installed in the base 101 and adjacent to the first extension arm 13, and the first switch conductive plate assembly 14 comprises a first pin sheet 141, a first middle elastic plate 142 and a first conductive plate 143. The first pin sheet 141 is partially fixed into the base 101. The first middle elastic plate 142 has an end fixedly coupled to the first pin sheet 141 in the base 101 and the other end having a first movable contact 1421 with a contact surface facing downward, and this end of the first middle elastic plate 142 is snapped and fixed to the first extension arm 13. The first conductive plate 143 is partially disposed in the base 101 and partially extending to the outside of the casing 10, and the end of the first conductive plate 143 disposed in the base 101 has a first fixed contact 1431 with a contact surface facing upward, and the first movable contact 1421 and the first fixed contact 1431 are configured to be corresponsive to each other. The first gripper module 15 and the first conductive plate 143 are fixedly coupled to each other and disposed outside the casing 10, and provided for installing or coupling an external component.

The second extension arm 16 is installed in a second slide groove 1012 of the base 101 and disposed on a side of the rotating bridge 12, and the second extension arm 16 has an end fixedly coupled to the second snap section 1232, and the second extension arm 16 is movable up and down in the second slide groove 1012. The second switch conductive plate assembly 17 is installed in the base 101 and adjacent to the second extension arm 16 comprises a second pin sheet 171, a second conductive plate 172 and a second middle elastic plate 173. The second pin sheet 171 is partially fixed into the base 101, and the end of the second pin sheet 171 disposed in the base 101 has a second fixed contact 1711 with a contact surface facing downward. The second conductive plate 172 is partially disposed in the base 101 and partially extending out of the casing 10. The second middle elastic plate 173 has an end fixedly coupled to the second conductive plate 172 in the base 101 and the other end having a second movable contact 1731 with a contact surface facing upward, and this end of the second middle elastic plate 173 is fixedly coupled to the second extension arm 16, and the second movable contact 1731 and the second fixed contact 1711 are configured to be corresponsive to each other. The second gripper module 18 and the second conductive plate 172 are fixedly coupled are fixedly coupled and disposed outside the casing 10, and provided for installing or coupling an external component.

With the structure of the rotating bridge 12, the first switch conductive plate assembly 14 and the second switch conductive plate assembly 17 can be operated synchronously. In other words, when the first movable contact 1421 and the first fixed contact 1431 in the first switch conductive plate assembly 14 are contacted or disconnected, the second movable contact 1731 and the second fixed contact 1711 in the second switch conductive plate assembly 17 will be contacted or disconnected synchronously, so that the electromagnetic relay 1 can be turned on/off more electrically stable. In addition to the synchronous operation of the two sets of switch conductive plate assemblies, the structure of the present invention also allows the first movable contact 1421 and the first fixed contact 1431 as well as the second movable contact 1731 and the second fixed contact 1711 to have a relatively larger and more appropriate force for their contact, and ensure a sure separation during disconnection, so as to reduce the change of resistance occurred during the operation of the electromagnetic relay 1 to achieve the effects of improving the reliability of electrical switch and increasing the service life of the electromagnetic relay 1.

Further, the electromagnetic relay 1 further comprises a fixed bridge 19 installed in the base 101 and having an end fixedly coupled to the first magnetic yoke arm 111 and the other end fixedly coupled to the second magnetic yoke arm 112, and spanning between the first magnetic yoke arm 111 and the second magnetic yoke arm 112. A pivot 1213 extends from two opposite sides of the containment 1211 of the rotating bridge 12 separately, and the base 101 and the fixed bridge 19 have a pivot hole 1013, 191 configured to be corresponsive to the respective pivot 1213, and each pivot 1213 is installed into the respective pivot hole 1013, 191, so that the rotating bridge 12 can be rotated by using the pivots 1013, 191 as the axis. With the structure of the fixed bridge 19, the pivot holes 1013, 191 of the base 101, and the pivots 1213, the rotating bridge 12 can be rotated by using the pivot 1213 as the axis to improve the rotation stability of the rotating bridge 12.

Preferably, the first extension arm 13 has a first snap slot 131 with an open end, and the first snap section 1231 of the rotating bridge 12 has a first connecting segment 12311 and a first snapping segment 12312, wherein the first snapping segment 12312 is connected to the first connecting segment 12311 to define the upward bending configuration, and the first snapping segment 12312 is snapped in from the open end of the first snap slot 131 and fixedly coupled into the first snap slot 131. The second extension arm 16 has a second snap slot 161 with an open end, and the second snap section 1232 of the rotating bridge 12 has a second connecting segment 12321 and a second snapping segment 12322, wherein the second snapping segment 12322 is connected to the second connecting segment 12321 to define the upward bending configuration, and the second snapping segment 12322 is snapped in from the open end of the second snap slot 161 and fixedly coupled to the second snap slot 161. When the first abutting section 1221 of the rotating bridge 12 abuts against an end of the first magnetic yoke arm 111, the junction of the first snapping segment 12312 and the first connecting segment 12311 abuts against the first snap slot 131, and an end of the second snapping segment 12322 abuts against the second snap slot 161. When the second abutting section 1222 of the rotating bridge 12 abuts against an end of the second magnetic yoke arm 112, an end of the first snapping segment 12312 abuts against the first snap slot 131, and the junction of the second snapping segment 12322 and the second connecting segment 12321 abuts against the second snap slot 161. Therefore, the operation of the rotating bridge 12 can be more stable, and the first switch conductive plate assembly 14 and the second switch conductive plate assembly 17 can be operated in a more synchronous manner.

Figure 1:
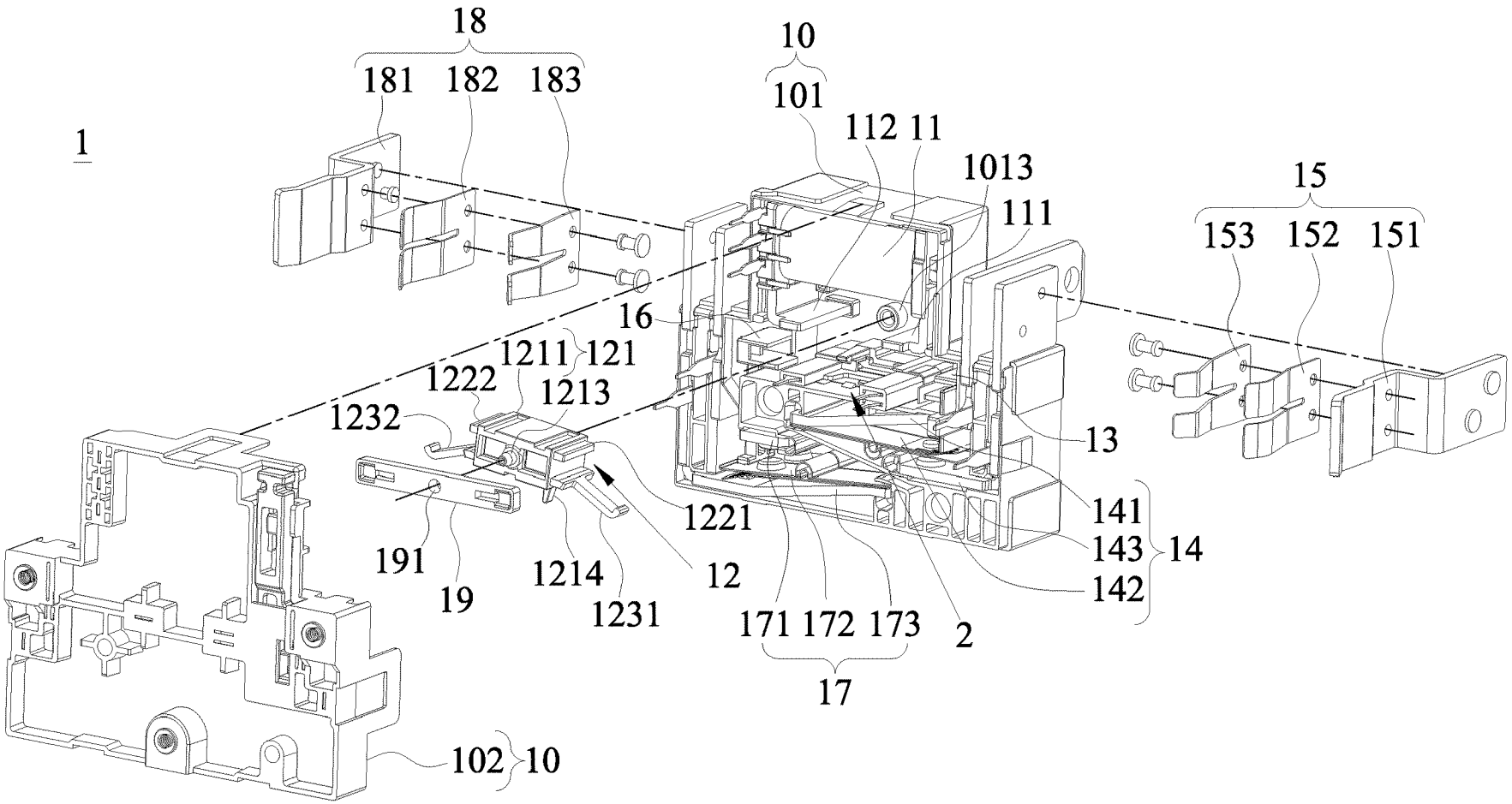
FIG. 1 is an exploded view of an electromagnetic relay in accordance with an embodiment of this disclosure.
Figure 2:
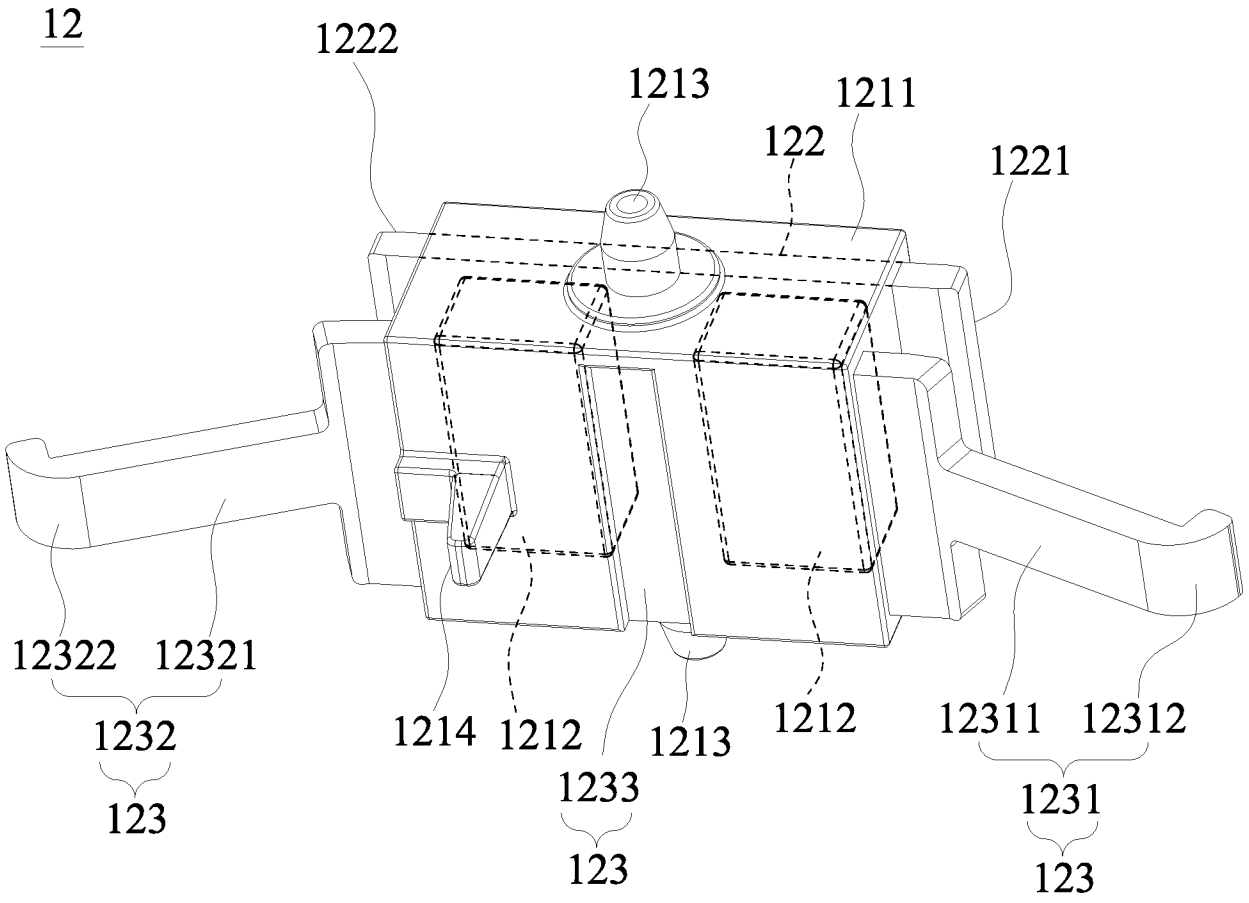
FIG. 2 is a schematic view of a rotating bridge in accordance with an embodiment of this disclosure.
Figure 3A:
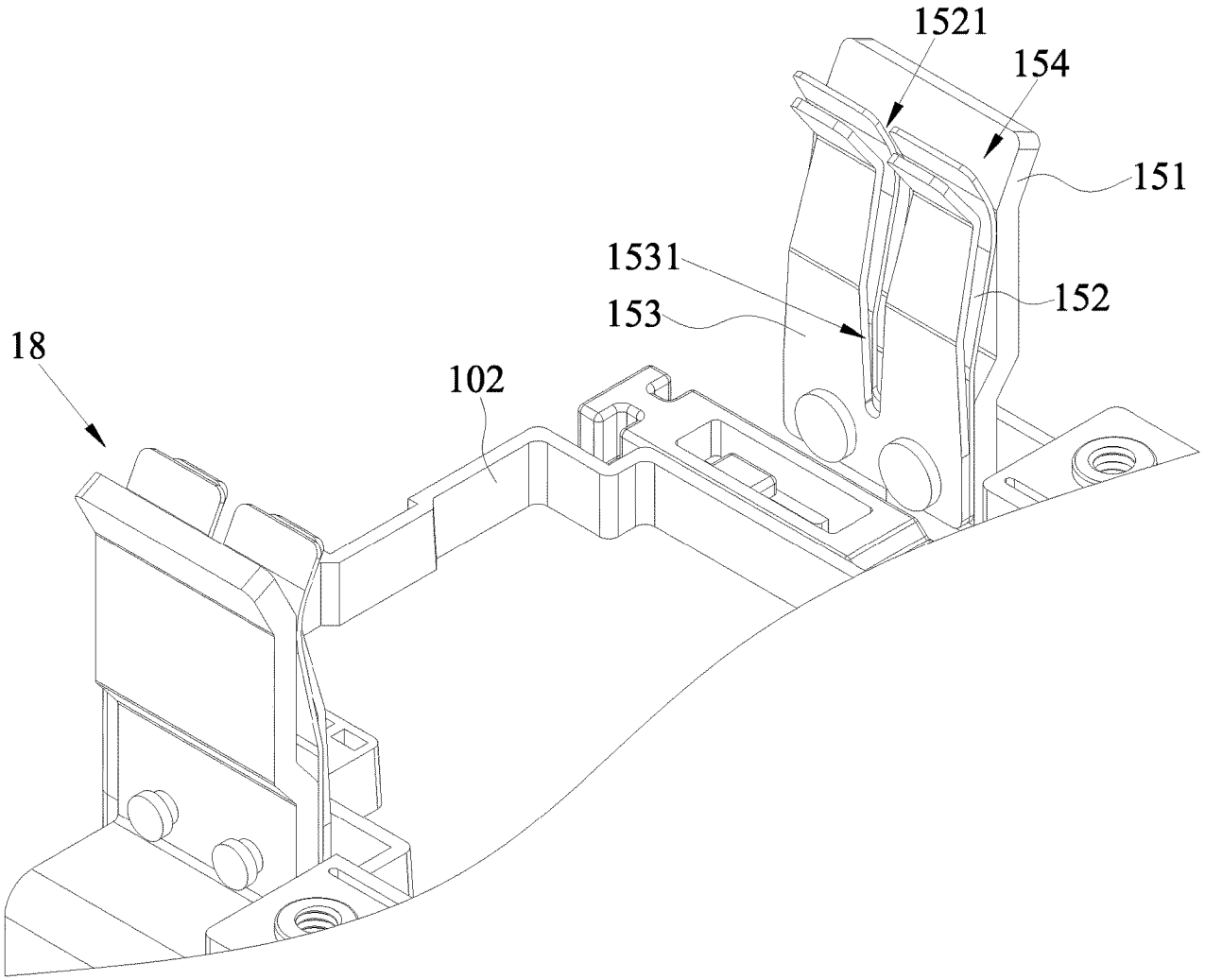
FIG. 3A is a schematic view of first and second gripper modules in accordance with an embodiment of this disclosure.
Figure 3B:
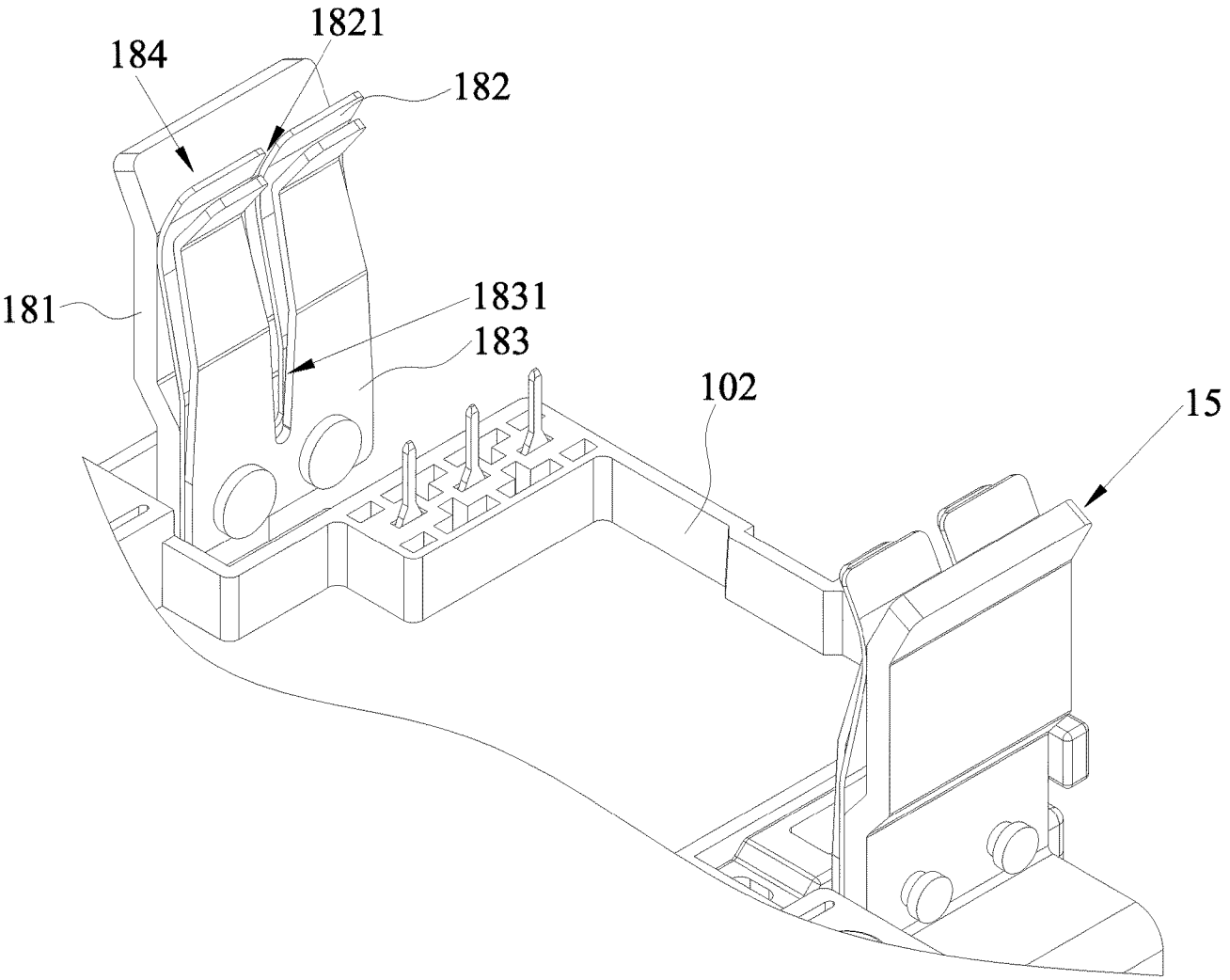
FIG. 3B is another schematic view of first and second gripper modules in accordance with an embodiment of this disclosure.
Figure 4A:
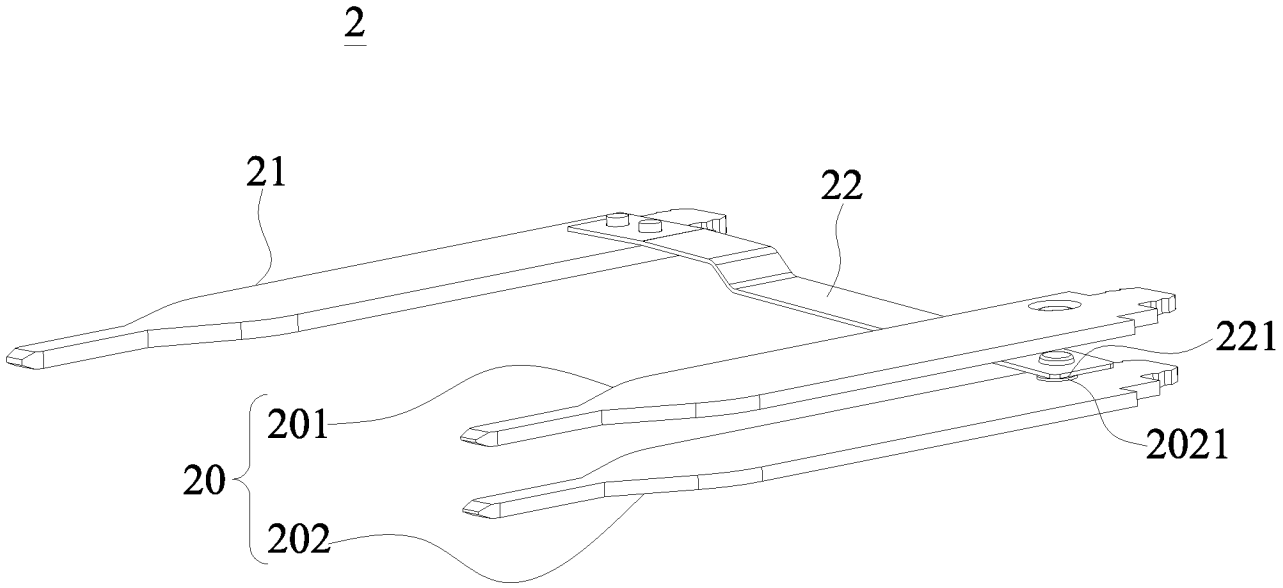
FIG. 4A is a schematic view of an auxiliary contact module in accordance with an embodiment of this disclosure.
Figure 4B:
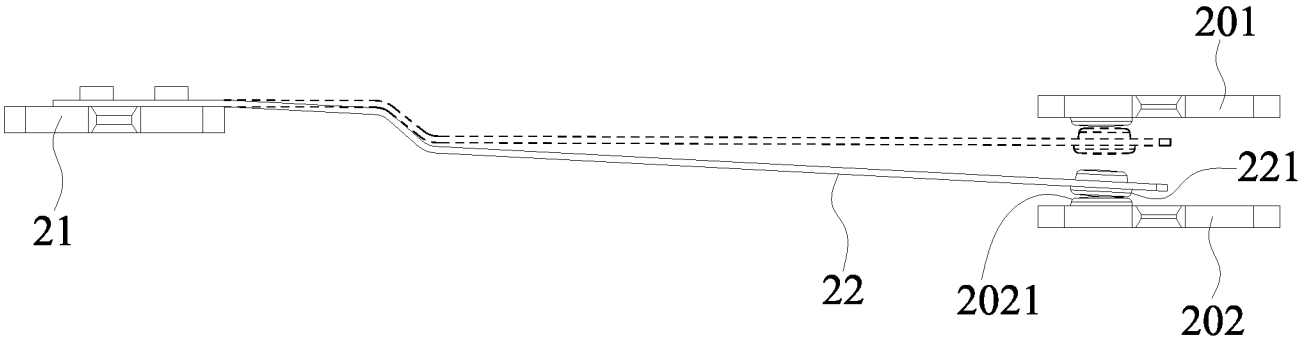
FIG. 4B is a schematic planar view of an auxiliary contact module in accordance with an embodiment of this disclosure.

In FIGS. 1, 3A, and 3B, FIGS. 3A and 3B are two schematic views showing the structure of first and second gripper modules in accordance with an embodiment of the present invention, the first gripper module 15 of a preferred implementation mode comprises a first primary clip 151, a first secondary clip 152 and a first elastic clip 153, and the first primary clip 151 is fixedly coupled to the first conductive plate 143, and the first secondary clip 152 is stacked on the first primary clip 151, and the first elastic clip 153 is stacked on the first secondary clip 152, wherein the first primary clip 151 and the first secondary clip 152 are bent in opposite bending directions, and a first gripper mouth 154 is formed at the ends after stacking; the first elastic clip 153 and the first secondary clip 152 are bent in the same bending direction, and the bent position of the first elastic clip 153 abuts against the bent position of the first secondary clip 152. The second gripper module 18 comprises a second primary clip 181, a second secondary clip 182 and a second elastic clip 183, and the second primary clip 181 is fixedly coupled to the second conductive plate 172, and the second secondary clip 182 is stacked on the second primary clip 181, and the second elastic clip 183 is stacked on the second secondary clip 182, wherein the second primary clip 181 and the second secondary clip 182 are bent in opposite bending directions to form a second gripper mouth 184 after stacking; the second elastic clip 183 and the second secondary clip 182 are bent in the same bending direction, and the bent position of the second elastic clip 183 abuts against the bent position of the second secondary clip 182. Since the first gripper module 15 and the second gripper module 18 are used for clamping and fixing external components and providing an electrical conduction function to facilitate the use of the electromagnetic relay 1. During assembling, the external components are inserted to the first gripper module 15 and the second gripper module 18, and the external components can be pulled for their removal. With the aforementioned technical characteristics, the first gripper module 15 and the second gripper module 18 have the advantage of easy plugging and unplugging to avoid a possible change in the gap of the first gripper mouth 154 or the second gripper mouth 184 caused by repeated plugging and unplugging operations which may affect the stability of the electromagnetic relay 1 due to the excessive change of resistance occurred during the assembling and using of the external components, while maintaining excellent clamping force and high conductivity. In other words, the first gripper mouth 154 is formed by the opposite bending directions of the first primary clip 151 and the first secondary clip 152, and the second gripper mouth 184 is formed by the bending directions of the second primary clip 181 and the second secondary clip 182. By the design of the bent position of the first elastic clip 153 abutting against the first secondary clip 152, and the bent position of the second elastic clip 183 abutting against the second secondary clip 182, the first elastic clip 153 and the second elastic clip 183 applies forces to abut the closing positions of the first gripper mouth 154 and the second gripper mouth 184 respectively to enhance and limit the closing force of the first gripper mouth 154 and the second gripper mouth 184, wherein the closing position refers to the mutual abutting area after the first primary clip 151 and the first secondary clip 152 are stacked, and the second primary clip 181 and the second secondary clip 182 are stacked.

Preferably, the first elastic clip 153 has at least one first elastic clip slot 1531 extending from an end towards the other end of the first elastic clip 153; the second elastic clip 183 has at least one second elastic clip slot 1831 extending from an end towards the other end of the second elastic clip 183, so that the first gripper module 15 and the second gripper module 18 have better plugging and unplugging effect, while taking the clamping force into account. In this embodiment, the first elastic clip 153 has one of the first elastic clip slots 1531, and the second elastic clip 183 has one of the second elastic clip slots 1831.

Besides the first elastic clip 153 and the second elastic clip 183 have the slot, the first secondary clip 152 in a preferred implementation mode has at least one first secondary clip slot 1521 configured to be corresponsive to the first elastic clip slot 1531, and the second secondary clip 182 has at least one second secondary clip slot 1821 configured to be corresponsive to the second elastic clip slot 1831 to improve the flexible change of the first gripper module 15 and the second gripper module 18 during application, so as to achieve the effects of reducing the possibility of having a change of the gap of the first gripper mouth 154 and the gap of the second gripper mouth 184 after their plugging and unplugging, and avoiding an excessive change of resistance at the gaps for each electrical conduction.

Figure 5:
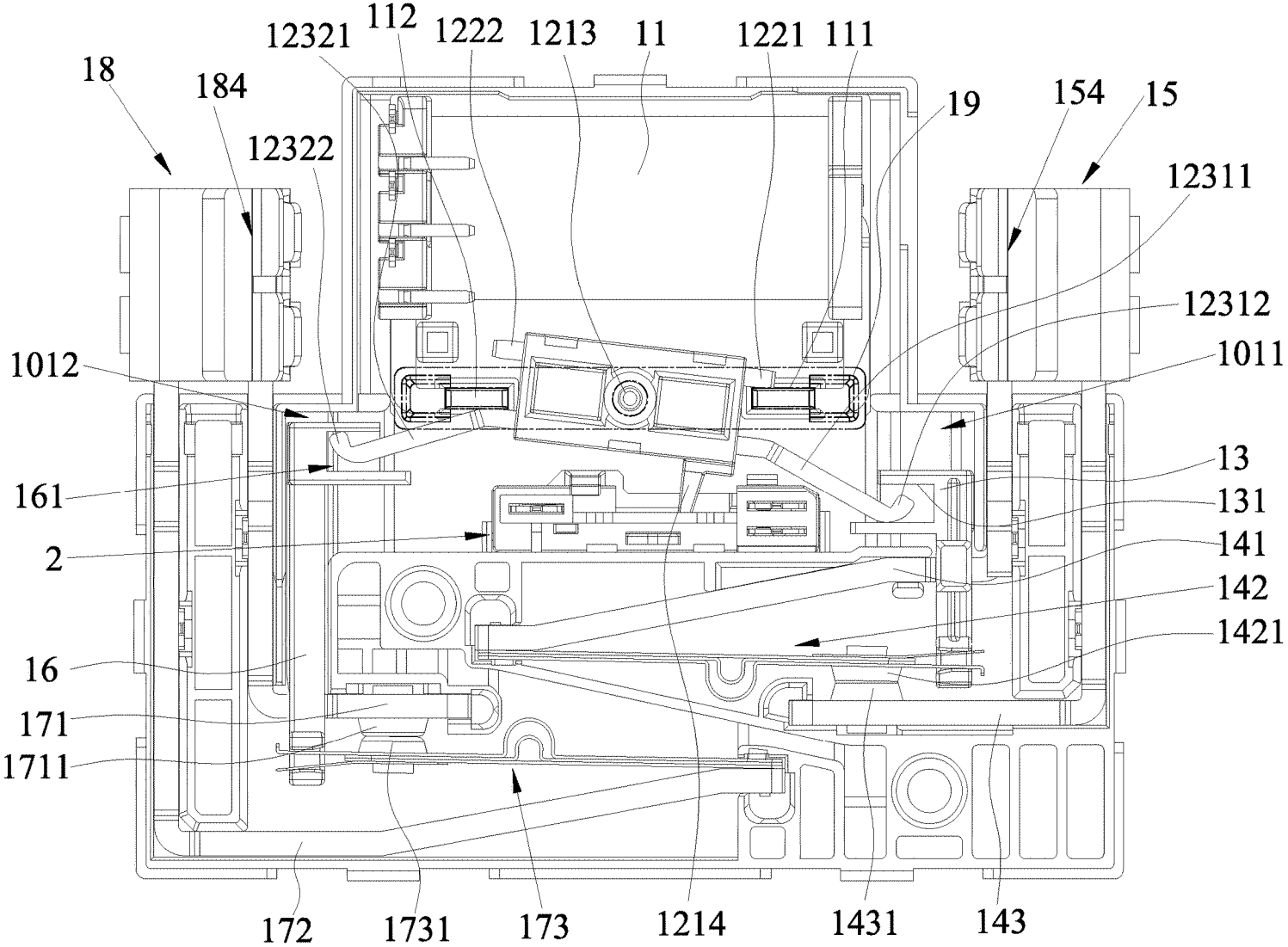
FIG. 5 is a first schematic view showing an application of an electromagnetic relay in accordance with an embodiment of this disclosure.
Figure 6:
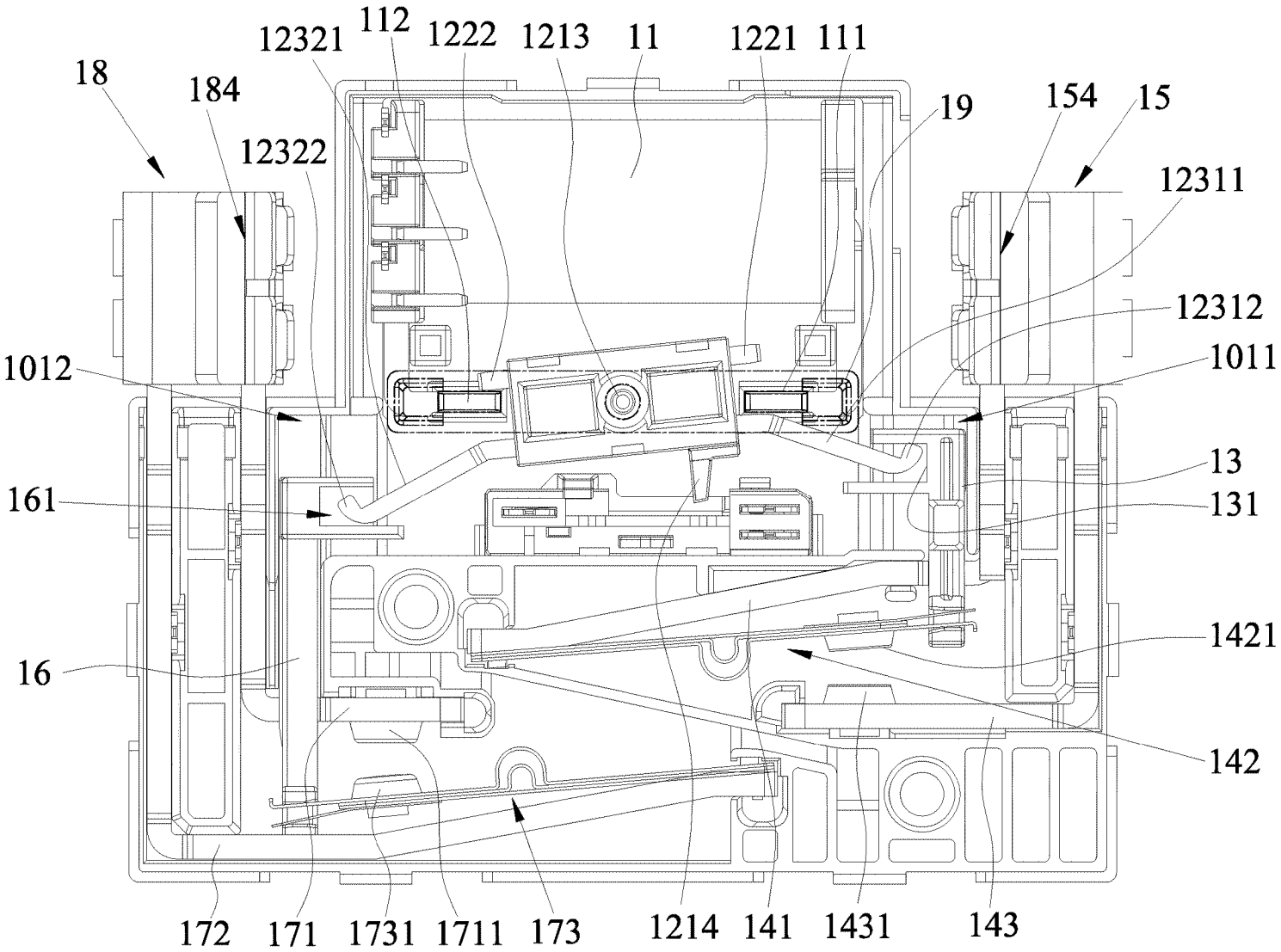
FIG. 6 is a second schematic view showing an application of an electromagnetic relay in accordance with an embodiment of this disclosure.
Figure 7A:
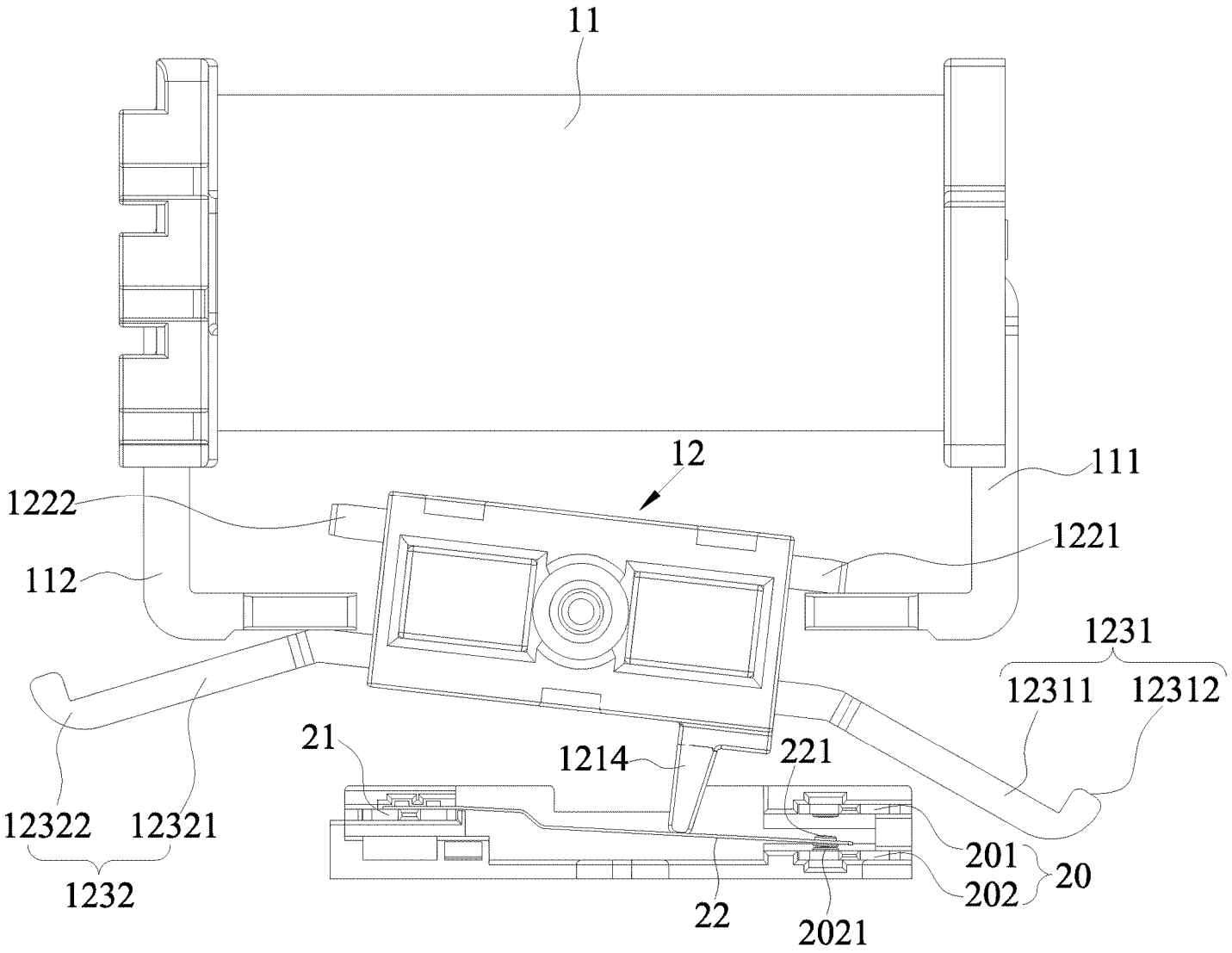
FIG. 7A is a first schematic view showing an operation of a rotating bridge and an auxiliary contact module in accordance with an embodiment of this disclosure.
Figure 7B:
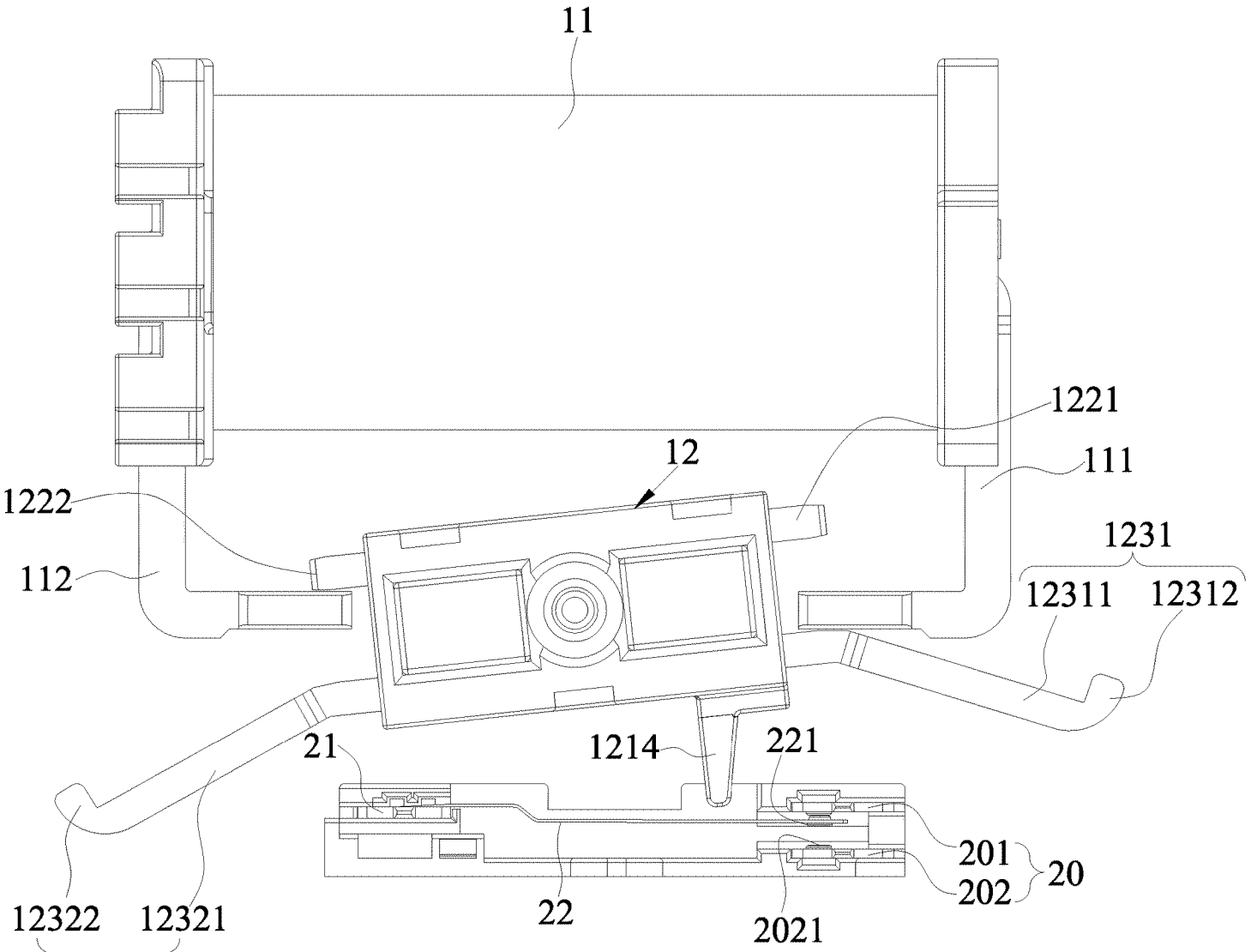
FIG. 7B is a second schematic view showing an operation of a rotating bridge and an auxiliary contact module in accordance with an embodiment of this disclosure.

With reference to FIGS. 1, 4A, 4B, 5, 6, 7A and 7B, FIGS. 4A and 4B are schematic view and planar view of an auxiliary contact module in accordance with an embodiment of the present invention respectively, and FIGS. 7A and 7B are first and second schematic views showing the operations of a rotating bridge and an auxiliary contact module in accordance with an embodiment of the present invention respectively. In order to confirm whether or not an operation status of the electromagnetic relay is normal, the electromagnetic relay 1 further comprises an auxiliary contact module 2 installed in the base 101 and disposed on a side of the rotating bridge 12, and the auxiliary contact module 2 comprises a first contact plate set 20, a second contact plate 21 and an elastic switching plate 22. The first contact plate set 20 has an upper auxiliary plate 201 and a lower auxiliary plate 202, wherein an end of the upper auxiliary plate 201 extends to the outside of the upper cover 102, and an end of the lower auxiliary plate 202 has a fixed auxiliary contact 2021 with a contact surface facing upward, the other end of the lower auxiliary plate 202 extends to the outside of the upper cover 102, and the second contact plate 21 is installed on a side of the first contact plate set 20 and has an end extending to a position out of the upper cover 102. The elastic switching plate 22 is transversely disposed between the first contact plate set 20 and the second contact plate 21, and the elastic switching plate 22 has an end fixedly coupled to the second contact plate 21 inside the base 101 and the other end extending to a position between the upper auxiliary plate 201 and the lower auxiliary plate 202 and having a movable auxiliary contact 221 provided for contacting or disconnecting the fixed auxiliary contact 2021. Wherein, an extension of the containment 1211 of the rotating bridge 12 has a pushing lever 1214 provided for pushing the elastic switching plate 22. When the first abutting section 1221 of the rotating bridge 12 abuts against an end of the first magnetic yoke arm 111, the pushing lever 1214 pushes the elastic switching plate 22 to contact the movable auxiliary contact 221 of the elastic switching plate 22 with the fixed auxiliary contact 2021. When the second abutting section 1222 of the rotating bridge 12 abuts against an end of the second magnetic yoke arm 112, the pushing lever 1214 does not push the elastic switching plate 22, so that the movable auxiliary contact 221 of the elastic switching plate 22 is disconnected from the fixed auxiliary contact 2021 to achieve the synchronous contact status or the synchronous disconnection status of the first movable contact 1421 and the first fixed contact 1431, the second movable contact 1731 and the second fixed contact 1711, and the movable auxiliary contact 221 and the fixed auxiliary contact 2021. By the synchronization of the auxiliary contact module 2 with the first switch conductive plate assembly 14 and the second switch conductive plate assembly 17, we can determine whether or not the operation is normal from the outside of the electromagnetic relay 1 to facilitate monitoring the status of the electromagnetic relay 1. In another implementation mode, the upper auxiliary plate 201 can also have a contact, and when the elastic switching plate 22 is displaced by the pushing lever 1214 of the rotating bridge 12, the movable auxiliary contact 221 will be contacted to the contact of the upper auxiliary plate 201 after being separated from the fixed auxiliary contact 2021. The aforementioned design of conduction, the effect of monitoring the status of the electromagnetic relay 1 from the outside by the auxiliary contact module 2 can be achieved. For example, various electrical values can be detected to determine whether or not the operation of the electromagnetic relay 1 is normal.

With reference to FIGS. 5-7B for the operation of the electromagnetic relay 1, the rotating bridge 12 is rotated to define a status of the first abutting section 1221 abutting against an end of the first magnetic yoke arm 111 or a status of the second abutting section 1222 abutting against an end of the second magnetic yoke arm 112 in accordance with a change of magnetic force the coil set 11, wherein the first switch conductive plate assembly 14, the second switch conductive plate assembly 17 and the auxiliary contact module 2 are linked according to the aforementioned status. In FIG. 5, the first abutting section 1221 of the rotating bridge 12 abuts against an end of the first magnetic yoke arm 111, and when the first abutting section 1221 abuts against an end of the first magnetic yoke arm 111, the junction of the first snapping segment 12312 and the first connecting segment 12311 of the first snap section 1231 abuts against the first snap slot 131 to move the first extension arm 13 which is a downward displacement as shown in the figure, so that the first movable contact 1421 of the first middle elastic plate 142 touches the first fixed contact 1431, and an end of the second snapping segment 12322 of the second snap section 1232 of the rotating bridge 12 abuts against the second snap slot 161 to move the second extension arm 16 in a direction away from the first extension arm 13, which is an upward displacement as shown in the figure, so that the second movable contact 1731 of the second middle elastic plate 173 touches the second fixed contact 1711. In FIG. 7A, the pushing lever 1214 of the rotating bridge 12 pushes the elastic switching plate 22, so that the movable auxiliary contact 221 of the elastic switching plate 22 touches the fixed auxiliary contact 2021 of the first contact plate set 20 to define a synchronous contact status of the first movable contact 1421 and the first fixed contact 1431, the second movable contact 1731 and the second fixed contact 1711, and the movable auxiliary contact 221 and the fixed auxiliary contact 2021.

FIG. 6 shows the status of the second abutting section 1222 of the rotating bridge 12 abutting against an end of the second magnetic yoke arm 112. When the second abutting section 1222 abuts against an end of the second magnetic yoke arm 112, an end of the first snapping segment 12312 of the first snap section 1231 abuts against the first snap slot 131 to move the first extension arm 13, and such movement is an upward displacement as shown in the figure, so as to disconnect the first movable contact 1421 of the first middle elastic plate 142 from the first fixed contact 1431, and the junction of the second snapping segment 12322 and the second connecting segment 12321 of the second snap section 1232 of the rotating bridge 12 abuts against the second snap slot 161, so that the second extension arm 16 moves in a direction away from the first extension arm 13, and such movement is a downward displacement as shown in the figure to disconnect the second movable contact 1731 of the second middle elastic plate 173 from the second fixed contact 1711. In FIG. 7B, the pushing lever 1214 of the rotating bridge 12 does not move the elastic switching plate 22, so that the movable auxiliary contact 221 of the elastic switching plate 22 is connected from the fixed auxiliary contact 2021 of the first contact plate set 20 to define a synchronous disconnection status of the first movable contact 1421 and the first fixed contact 1431, the second movable contact 1731 and the second fixed contact 1711, and the movable auxiliary contact 221 and the fixed auxiliary contact 2021.

In FIGS. 1 and 8, FIG. 8 is the exploded view of first and second gripper modules 15, 18 in accordance with another implementation mode of an embodiment of the present invention, the first elastic clip slot 1531 comes with a plural quantity, and the first elastic clip slots 1531 are configured to be parallel to one another; and the second elastic clip slot 1831 comes with a plural quantity, and the second elastic clip slots 1831 are configured to be parallel to one another. Similarly, the first secondary clip slot 1521 comes with a plural quantity, and the first secondary clip slots 1521 are configured to be parallel to one another; and the second secondary clip slot 1821 comes with a plural quantity, and the second secondary clip slots 1821 are configured to be parallel to one another as shown in FIG. 8. By the structure having the plurality of parallel slots, the convenience of plugging and unplugging the first gripper module 15 and the second gripper module 18 can be improved, while maintaining sufficient clamping force and excellent electrical conduction.

In summation of the description above, the novel structural design of the electromagnetic relay 1 of the present invention effectively improves the operation stability. Specifically, the structure of the rotating bridge 12 allows the first switch conductive plate assembly 14 and the second switch conductive plate assembly 17 in the electromagnetic relay 1 to achieve synchronous contact or disconnection during operation and provides an appropriate force to the fixed contact and the movable contact for their contact and ensures a reliable separation for their disconnection, so as to avoid an excessive resistance change and a high temperature occurred during the disconnection or contact of the contacts, which can improve the stability and safety of the application of the electromagnetic relay 1. Further, the present invention also improves the using performance with detailed technical characteristics. For example, the fixed bridge 19 is provided to improve the rotational stability of the rotating bridge 12, and the structural design of the first clip set 15 and the second clip set 18 and the installation of the auxiliary contact module 2 can improve the application performance of the electromagnetic relay 1.

What is claimed is:

1. An electromagnetic relay, comprising:

a casing, having a base and an upper cover;

a coil set, installed in the base, and having a first magnetic yoke arm and a second magnetic yoke arm extending from both ends of axis of the coil set respectively;

a rotating bridge, pivoted in the base, and disposed on a side of the coil set, and the rotating bridge, comprising:

a main body, having a containment, and a plurality of magnetic elements installed in the containment;

an abutting plate, penetrating through an upper end of the containment, and having a first abutting section and a second abutting section formed on both ends of the upper end of the containment respectively; wherein when the coil set changes its magnetic force, the rotating bridge rotates accordingly to define a status of abutting the first abutting section against an end of the first magnetic yoke arm, or the second abutting section against an end of the second magnetic yoke arm; and a link plate, penetrating through a lower end of the containment, and having a penetrating portion, a first snap section, and a second snap section, and the penetrating portion being a rectangular plate disposed in the containment, and the first snap section and the second snap section being coupled to both sides of the penetrating portion respectively and extending outwardly from both sides of the lower end of the containment respectively; wherein the first snap section and the second snap section are respectively formed a downward bending configuration relative to the penetration portion, and the end of the first snap section and the end of the second snap section are respectively formed a upward bending configuration;

a first extension arm, installed into a first slide groove in the base and disposed on a side of the rotating bridge, and an end of the first extension arm being fixedly coupled to the first snap section, and the first extension arm being movable up and down in the first slide groove;

a first switch conductive plate assembly, installed in the base, and disposed adjacent to the first extension arm, comprising:

a first pin sheet, partially fixed into the base;

a first middle elastic plate, having an end fixedly coupled to the first pin sheet in the base and the other end having a first movable contact with a contact surface facing downward, and this end being fixedly coupled to the first extension arm; and a first conductive plate, partially disposed in the base, and partially extending to the outside of the casing, and an end of the first conductive plate installed in the base having a first fixed contact with a contact surface facing upward, and the first movable contact and the first fixed contact being configured to be corresponsive to each other;

a first gripper module, fixedly coupled to the first conductive plate and disposed outside the casing;

a second extension arm, installed into a second slide groove in the base and disposed on a side of the rotating bridge, and the second extension arm having an end fixedly coupled to the second snap section, and the second extension arm being movable up and down in the second slide groove;

a second switch conductive plate assembly, installed in the base and disposed adjacent to the second extension arm, comprising:

a second pin sheet, partially fixed into the base, and an end of the base having a second fixed contact with a contact surface facing downward;

a second conductive plate, partially disposed in the base, and partially extending to the outside of the casing; and a second middle elastic plate, having an end fixedly coupled to the second conductive plate in the base and the other end having a second movable contact with a contact surface facing upward, and this end being fixedly coupled to the second extension arm, and the second movable contact and the second fixed contact being configured to be corresponsive to each other; and a second gripper module, fixedly coupled to the second conductive plate, and disposed outside the casing.

2. The electromagnetic relay as claimed in claim 1, further comprising a fixed bridge installed in the base, and having an end fixedly coupled to the first magnetic yoke arm and the other end fixedly coupled to the second magnetic yoke arm, and spanning between the first magnetic yoke arm and the second magnetic yoke arm; a pivot, extending from two opposite sides of the containment of the rotating bridge separately, and a pivot hole formed on the base and the fixed bridge separately and configured to be corresponsive to the pivots respectively, and each of the pivots being installed in the pivot holes respectively, so that the rotating bridge can be rotated by using the pivots as the axis.

3. The electromagnetic relay as claimed in claim 2, further comprising an auxiliary contact module installed in the base and disposed on a side of the rotating bridge, and the auxiliary contact module comprising:

a first contact plate set, having an upper auxiliary plate and a lower auxiliary plate, and an end of the upper auxiliary plate extending to the outside of the upper cover, and an end of the lower auxiliary plate having a fixed auxiliary contact with a contact surface facing upward, and the other end of the lower auxiliary plate extending to the outside of the upper cover;

a second contact plate, disposed on a side of the first contact plate set, and having an end extending to the outside of the upper cover; and an elastic switching plate, transversally installed between the first contact plate set and the second contact plate, and having an end fixedly coupled to the second contact plate in the base and the other end extending to a position between the upper auxiliary plate and the lower auxiliary plate and having a movable auxiliary contact for contacting or disconnecting the fixed auxiliary contact;

wherein, a pushing lever extends from the containment of the rotating bridge and is provided for pushing the elastic switching plate, so that when the first abutting section of the rotating bridge abuts against an end of the first magnetic yoke arm, the pushing lever pushes the elastic switching plate, so that the movable auxiliary contact of the elastic switching plate touches the fixed auxiliary contact; and when the second abutting section of the rotating bridge abuts against an end of the second magnetic yoke arm, the pushing lever does not move the elastic switching plate, so that the movable auxiliary contact of the elastic switching plate is disconnects from the fixed auxiliary contact; wherein defining a synchronous contact or disconnection status of the first movable contact and the first fixed contact, the second movable contact and the second fixed contact, and the movable auxiliary contact and the fixed auxiliary contact.

4. The electromagnetic relay as claimed in claim 2, wherein the first extension arm has a first snap slot with an open end, and the first snap section of the rotating bridge has a first connecting segment and a first snapping segment; wherein the first snapping segment is coupled to the first connecting segment to define the upward bending configuration, and the first snapping segment is snapped in from the open end of the first snap slot and fixedly coupled to the first snap slot;

the second extension arm has a second snap slot with an open end, and the second snap section of the rotating bridge has a second connecting segment and a second snapping segment; wherein the second snapping segment and the second connecting segment are coupled to define the upward bending configuration, and the second snapping segment is snapped in from the open end of the second snap slot and fixedly coupled to the second snap slot;

wherein, when the first abutting section of the rotating bridge abuts against an end of the first magnetic yoke arm, the junction of the first snapping segment and the first connecting segment abuts against the first snap slot, and the end of the second snapping segment abuts against the second snap slot; and when the second abutting section of the rotating bridge abuts against an end of the second magnetic yoke arm, the end of the first snapping segment abuts against the first snap slot, and the junction of the second snapping segment and the second connecting segment abuts against the second snap slot.

5. The electromagnetic relay as claimed in claim 4, further comprising an auxiliary contact module installed in the base and disposed on a side of the rotating bridge, and the auxiliary contact module comprising:

a first contact plate set, having an upper auxiliary plate and a lower auxiliary plate, and an end of the upper auxiliary plate extending to the outside of the upper cover, and an end of the lower auxiliary plate having a fixed auxiliary contact with a contact surface facing upward, and the other end of the lower auxiliary plate extending to the outside of the upper cover;

a second contact plate, disposed on a side of the first contact plate set, and having an end extending to the outside of the upper cover; and an elastic switching plate, transversally installed between the first contact plate set and the second contact plate, and having an end fixedly coupled to the second contact plate in the base and the other end extending to a position between the upper auxiliary plate and the lower auxiliary plate and having a movable auxiliary contact for contacting or disconnecting the fixed auxiliary contact;

wherein, a pushing lever extends from the containment of the rotating bridge and is provided for pushing the elastic switching plate, so that when the first abutting section of the rotating bridge abuts against an end of the first magnetic yoke arm, the pushing lever pushes the elastic switching plate, so that the movable auxiliary contact of the elastic switching plate touches the fixed auxiliary contact; and when the second abutting section of the rotating bridge abuts against an end of the second magnetic yoke arm, the pushing lever does not move the elastic switching plate, so that the movable auxiliary contact of the elastic switching plate is disconnects from the fixed auxiliary contact; wherein defining a synchronous contact or disconnection status of the first movable contact and the first fixed contact, the second movable contact and the second fixed contact, and the movable auxiliary contact and the fixed auxiliary contact.

6. The electromagnetic relay as claimed in claim 4, wherein the first gripper module comprises a first primary clip, a first secondary clip and a first elastic clip, and the first primary clip is fixedly coupled to the first conductive plate, and the first secondary clip is stacked on the first primary clip, and the first elastic clip is stacked on the first secondary clip; wherein, the first primary clip and the first secondary clip are bent in opposite directions to form a first gripper mouth at the ends thereof after stacking, and the first elastic clip and the first secondary clip are bent in the same direction, and the bent position of the first elastic clip abuts against the bent position of the first secondary clip;

the second gripper module comprises a second primary clip, a second secondary clip and a second elastic clip, and the second primary clip is fixedly coupled to the second conductive plate, and the second secondary clip is stacked on the second primary clip, and the second elastic clip is stacked on the second secondary clip; wherein, the second primary clip and the second secondary clip are bent in opposite directions to form a second gripper mouth at the ends thereof after stacking; and the second elastic clip and the second secondary clip are bent in the same direction, and the bent position of the second elastic clip abuts against the bent position of the second secondary clip.

7. The electromagnetic relay as claimed in claim 6, further comprising an auxiliary contact module installed in the base and disposed on a side of the rotating bridge, and the auxiliary contact module comprising:

a first contact plate set, having an upper auxiliary plate and a lower auxiliary plate, and an end of the upper auxiliary plate extending to the outside of the upper cover, and an end of the lower auxiliary plate having a fixed auxiliary contact with a contact surface facing upward, and the other end of the lower auxiliary plate extending to the outside of the upper cover;

a second contact plate, disposed on a side of the first contact plate set, and having an end extending to the outside of the upper cover; and an elastic switching plate, transversally installed between the first contact plate set and the second contact plate, and having an end fixedly coupled to the second contact plate in the base and the other end extending to a position between the upper auxiliary plate and the lower auxiliary plate and having a movable auxiliary contact for contacting or disconnecting the fixed auxiliary contact;

wherein, a pushing lever extends from the containment of the rotating bridge and is provided for pushing the elastic switching plate, so that when the first abutting section of the rotating bridge abuts against an end of the first magnetic yoke arm, the pushing lever pushes the elastic switching plate, so that the movable auxiliary contact of the elastic switching plate touches the fixed auxiliary contact; and when the second abutting section of the rotating bridge abuts against an end of the second magnetic yoke arm, the pushing lever does not move the elastic switching plate, so that the movable auxiliary contact of the elastic switching plate is disconnects from the fixed auxiliary contact; wherein defining a synchronous contact or disconnection status of the first movable contact and the first fixed contact, the second movable contact and the second fixed contact, and the movable auxiliary contact and the fixed auxiliary contact.

8. The electromagnetic relay as claimed in claim 6, wherein the first elastic clip has at least one first elastic clip slot formed thereon and extending from an end towards the other end of the first elastic clip, and the second elastic clip has at least one second elastic clip slot formed thereon and extending from an end towards the other end of the second elastic clip.

9. The electromagnetic relay as claimed in claim 8, further comprising an auxiliary contact module installed in the base and disposed on a side of the rotating bridge, and the auxiliary contact module comprising:

a first contact plate set, having an upper auxiliary plate and a lower auxiliary plate, and an end of the upper auxiliary plate extending to the outside of the upper cover, and an end of the lower auxiliary plate having a fixed auxiliary contact with a contact surface facing upward, and the other end of the lower auxiliary plate extending to the outside of the upper cover;

a second contact plate, disposed on a side of the first contact plate set, and having an end extending to the outside of the upper cover; and an elastic switching plate, transversally installed between the first contact plate set and the second contact plate, and having an end fixedly coupled to the second contact plate in the base and the other end extending to a position between the upper auxiliary plate and the lower auxiliary plate and having a movable auxiliary contact for contacting or disconnecting the fixed auxiliary contact;

wherein, a pushing lever extends from the containment of the rotating bridge and is provided for pushing the elastic switching plate, so that when the first abutting section of the rotating bridge abuts against an end of the first magnetic yoke arm, the pushing lever pushes the elastic switching plate, so that the movable auxiliary contact of the elastic switching plate touches the fixed auxiliary contact; and when the second abutting section of the rotating bridge abuts against an end of the second magnetic yoke arm, the pushing lever does not move the elastic switching plate, so that the movable auxiliary contact of the elastic switching plate is disconnects from the fixed auxiliary contact; wherein defining a synchronous contact or disconnection status of the first movable contact and the first fixed contact, the second movable contact and the second fixed contact, and the movable auxiliary contact and the fixed auxiliary contact.

10. The electromagnetic relay as claimed in claim 8, wherein when the first elastic clip slot comes with a plural quantity, the first elastic clip slots are configured to be parallel to one another; and when the second elastic clip slot comes with a plural quantity, the second elastic clip slots are configured to be parallel to one another.

11. The electromagnetic relay as claimed in claim 10, further comprising an auxiliary contact module installed in the base and disposed on a side of the rotating bridge, and the auxiliary contact module comprising:

a first contact plate set, having an upper auxiliary plate and a lower auxiliary plate, and an end of the upper auxiliary plate extending to the outside of the upper cover, and an end of the lower auxiliary plate having a fixed auxiliary contact with a contact surface facing upward, and the other end of the lower auxiliary plate extending to the outside of the upper cover;

a second contact plate, disposed on a side of the first contact plate set, and having an end extending to the outside of the upper cover; and an elastic switching plate, transversally installed between the first contact plate set and the second contact plate, and having an end fixedly coupled to the second contact plate in the base and the other end extending to a position between the upper auxiliary plate and the lower auxiliary plate and having a movable auxiliary contact for contacting or disconnecting the fixed auxiliary contact;

wherein, a pushing lever extends from the containment of the rotating bridge and is provided for pushing the elastic switching plate, so that when the first abutting section of the rotating bridge abuts against an end of the first magnetic yoke arm, the pushing lever pushes the elastic switching plate, so that the movable auxiliary contact of the elastic switching plate touches the fixed auxiliary contact; and when the second abutting section of the rotating bridge abuts against an end of the second magnetic yoke arm, the pushing lever does not move the elastic switching plate, so that the movable auxiliary contact of the elastic switching plate is disconnects from the fixed auxiliary contact; wherein defining a synchronous contact or disconnection status of the first movable contact and the first fixed contact, the second movable contact and the second fixed contact, and the movable auxiliary contact and the fixed auxiliary contact.

12. The electromagnetic relay as claimed in claim 10, wherein the first secondary clip has at least one first secondary clip slot formed thereon and configured to be corresponsive to the first elastic clip slot, and the second secondary clip has at least one second secondary clip slot formed thereon and configured to be corresponsive to the second elastic clip slot.

13. The electromagnetic relay as claimed in claim 12, further comprising an auxiliary contact module installed in the base and disposed on a side of the rotating bridge, and the auxiliary contact module comprising:

a first contact plate set, having an upper auxiliary plate and a lower auxiliary plate, and an end of the upper auxiliary plate extending to the outside of the upper cover, and an end of the lower auxiliary plate having a fixed auxiliary contact with a contact surface facing upward, and the other end of the lower auxiliary plate extending to the outside of the upper cover;

a second contact plate, disposed on a side of the first contact plate set, and having an end extending to the outside of the upper cover; and an elastic switching plate, transversally installed between the first contact plate set and the second contact plate, and having an end fixedly coupled to the second contact plate in the base and the other end extending to a position between the upper auxiliary plate and the lower auxiliary plate and having a movable auxiliary contact for contacting or disconnecting the fixed auxiliary contact;

wherein, a pushing lever extends from the containment of the rotating bridge and is provided for pushing the elastic switching plate, so that when the first abutting section of the rotating bridge abuts against an end of the first magnetic yoke arm, the pushing lever pushes the elastic switching plate, so that the movable auxiliary contact of the elastic switching plate touches the fixed auxiliary contact; and when the second abutting section of the rotating bridge abuts against an end of the second magnetic yoke arm, the pushing lever does not move the elastic switching plate, so that the movable auxiliary contact of the elastic switching plate is disconnects from the fixed auxiliary contact; wherein defining a synchronous contact or disconnection status of the first movable contact and the first fixed contact, the second movable contact and the second fixed contact, and the movable auxiliary contact and the fixed auxiliary contact.

14. The electromagnetic relay as claimed in claim 12, wherein when the first secondary clip slot comes with a plural quantity, the first secondary clip slots are configured to be parallel to one another; and when the second secondary clip slot comes with a plural quantity, the secondary clip slots are configured to be parallel to one another.

15. The electromagnetic relay as claimed in claim 14, further comprising an auxiliary contact module installed in the base and disposed on a side of the rotating bridge, and the auxiliary contact module comprising:

a first contact plate set, having an upper auxiliary plate and a lower auxiliary plate, and an end of the upper auxiliary plate extending to the outside of the upper cover, and an end of the lower auxiliary plate having a fixed auxiliary contact with a contact surface facing upward, and the other end of the lower auxiliary plate extending to the outside of the upper cover;

a second contact plate, disposed on a side of the first contact plate set, and having an end extending to the outside of the upper cover; and an elastic switching plate, transversally installed between the first contact plate set and the second contact plate, and having an end fixedly coupled to the second contact plate in the base and the other end extending to a position between the upper auxiliary plate and the lower auxiliary plate and having a movable auxiliary contact for contacting or disconnecting the fixed auxiliary contact;

wherein, a pushing lever extends from the containment of the rotating bridge and is provided for pushing the elastic switching plate, so that when the first abutting section of the rotating bridge abuts against an end of the first magnetic yoke arm, the pushing lever pushes the elastic switching plate, so that the movable auxiliary contact of the elastic switching plate touches the fixed auxiliary contact; and when the second abutting section of the rotating bridge abuts against an end of the second magnetic yoke arm, the pushing lever does not move the elastic switching plate, so that the movable auxiliary contact of the elastic switching plate is disconnects from the fixed auxiliary contact; wherein defining a synchronous contact or disconnection status of the first movable contact and the first fixed contact, the second movable contact and the second fixed contact, and the movable auxiliary contact and the fixed auxiliary contact.

16. The electromagnetic relay as claimed in claim 1, further comprising an auxiliary contact module installed in the base and disposed on a side of the rotating bridge, and the auxiliary contact module comprising:

a first contact plate set, having an upper auxiliary plate and a lower auxiliary plate, and an end of the upper auxiliary plate extending to the outside of the upper cover, and an end of the lower auxiliary plate having a fixed auxiliary contact with a contact surface facing upward, and the other end of the lower auxiliary plate extending to the outside of the upper cover;

a second contact plate, disposed on a side of the first contact plate set, and having an end extending to the outside of the upper cover; and an elastic switching plate, transversally installed between the first contact plate set and the second contact plate, and having an end fixedly coupled to the second contact plate in the base and the other end extending to a position between the upper auxiliary plate and the lower auxiliary plate and having a movable auxiliary contact for contacting or disconnecting the fixed auxiliary contact;

wherein, a pushing lever extends from the containment of the rotating bridge and is provided for pushing the elastic switching plate, so that when the first abutting section of the rotating bridge abuts against an end of the first magnetic yoke arm, the pushing lever pushes the elastic switching plate, so that the movable auxiliary contact of the elastic switching plate touches the fixed auxiliary contact; and when the second abutting section of the rotating bridge abuts against an end of the second magnetic yoke arm, the pushing lever does not move the elastic switching plate, so that the movable auxiliary contact of the elastic switching plate is disconnects from the fixed auxiliary contact; wherein defining a synchronous contact or disconnection status of the first movable contact and the first fixed contact, the second movable contact and the second fixed contact, and the movable auxiliary contact and the fixed auxiliary contact.

* * * * *